US008870730B2

(12) United States Patent
Hyder et al.

(10) Patent No.: US 8,870,730 B2
(45) Date of Patent: Oct. 28, 2014

(54) CUP LID MANUFACTURING PROCESS

(75) Inventors: Lonnie E. Hyder, Huntington, IN (US); Michael E. Tibbets, Converse, IN (US)

(73) Assignee: Peerless Machine & Tool Corporation, Marion, IN (US)

( * ) Notice: Subject to any disclaimer, the term of this patent is extended or adjusted under 35 U.S.C. 154(b) by 931 days.

(21) Appl. No.: 12/729,355

(22) Filed: Mar. 23, 2010

(65) Prior Publication Data

US 2010/0243722 A1 Sep. 30, 2010

Related U.S. Application Data

(60) Provisional application No. 61/162,900, filed on Mar. 24, 2009.

(51) Int. Cl.
*B31B 1/62* (2006.01)

(52) U.S. Cl.
USPC ..... 493/143; 493/108; 493/154

(58) Field of Classification Search
USPC ..... 493/143, 144, 158, 58, 108, 154
See application file for complete search history.

(56) References Cited

U.S. PATENT DOCUMENTS

| | | | | |
|---|---|---|---|---|
| 2,959,110 | A | 11/1960 | Thoma | |
| 5,014,500 | A * | 5/1991 | Robache | 53/559 |
| 5,170,611 | A * | 12/1992 | Buchko et al. | 53/453 |
| 5,307,610 | A * | 5/1994 | Schneider et al. | 53/559 |
| 6,240,706 | B1 * | 6/2001 | Thomas et al. | 53/329.3 |
| 6,616,586 | B2 * | 9/2003 | Dai | 493/158 |
| 6,641,515 | B2 * | 11/2003 | Ferri et al. | 493/158 |
| 6,843,043 | B2 * | 1/2005 | Hanson et al. | 53/510 |
| 7,607,279 | B2 * | 10/2009 | Shackelford et al. | 53/453 |
| 7,753,832 | B2 * | 7/2010 | Karine et al. | 493/143 |
| 7,914,432 | B2 * | 3/2011 | Zelinski | 493/143 |

FOREIGN PATENT DOCUMENTS

FR 878487 A 1/1943

OTHER PUBLICATIONS

European Search Report; Jun. 26, 2012.
International Search Report; May 21, 2010.

* cited by examiner

*Primary Examiner* — Sameh H. Tawfik
(74) *Attorney, Agent, or Firm* — Barnes & Thornburg LLP

(57) ABSTRACT

A substantially crimpless and monolithic paperboard container lid and method of making same is provided. The lid comprises a single contiguous molded paperboard body configured to conformingly couple to a top periphery of a container for covering the container's opening. The body includes a sealing ring located adjacent the body's periphery. The sealing ring includes a sealing channel composed of a radiused cross-section that extends to a tangent ring terminating with a tab ring. The radiused cross-section and tangent ring assist providing a snug fit between the lid and the container. Despite being made from paperboard, the lid does not include one or more substantial crimps in the sealing ring. Having no substantial crimps, the lid fits onto the container and prevents fluid from leaking between the container's periphery and the lid.

3 Claims, 12 Drawing Sheets

CUP LID MANUFACTURING PROCESS

RELATED APPLICATIONS

The present application is related to and claims priority to U.S. Provisional Patent Application Ser. No. 61/162,900, filed on Mar. 24, 2009, entitled "Cup Lid Manufacturing Process." To the extent not included below, the subject matter disclosed in that application is hereby expressly incorporated into the present application.

TECHNICAL FIELD AND SUMMARY

The present disclosure relates to paper-based container lids and, particularly, lids of the type used for fluid containers, such as cups or bowls, to hold hot liquids, such as coffee or soup, for example.

Plastic coffee cup lids, such as those used by restaurants, convenience stores, and coffee houses, are known. They commonly fit onto the top of paper cups to keep the contents from spilling out. Such lids are not made from a single paperboard blank because they do not effectively seal around the container's rim. The problem is in manufacturing paperboard lids. Substantial crimps in the lid's sealing ring form during manufacturing causing gaps in the paperboard. When the ring attaches to the rim of a cup or container, these gaps are a source of fluid leaks. This is why molded plastic remains the material of choice for cup lids.

The present disclosure describes a departure from plastic cup lids in favor of a paper-based board lid and method for manufacture of the same. These paperboard lids are manufactured without the substantial crimps formed in their sealing rings. The result is an effective paperboard container lid. This disclosure also contemplates using water-resistant coated paper such as a polycoated paper or board. It is appreciated that embodiments of the present disclosure may have nominal crimps on the outside surface of the sealing ring, but not on the inside portion of the ring sealing the container.

An illustrative embodiment of this paperboard lid includes a circular channel that formingly secures or "snaps-on" to a rim conventionally used at the open edge of a paperboard container, such as on a coffee or soup cup. An embodiment may also include a stacking ring that allows the bottom of a cup to be fitted onto the paperboard lid. This better secures cups stacked on top of each other.

A further illustrative method of manufacture of these lids includes providing an unformed lid blank. In one illustrative embodiment, the blank can have radially-extending grooves to aid in forming a sealing channel adjacent the periphery of the lid. The blank is then positioned inside a press that uses compression forces to form the final shape of the lid. A combination of draw and pressure rings hold the blank in place while male and female mold components compress the blank. Because the lid is to fit around the rim of a cup, the lid blank does not remain flat, but forms a three-dimensional shape having a sealing channel that receives the rim of the cup. Consequently, as the draw and pressure rings hold the paper blank, slides located at the periphery of the male and female mold components draw in laterally with respect to the blank adding lateral pressure. The multiple slides converge around the male and female mold components. In addition, the shape of the slides illustratively corresponds to the shape of the rim of the cup. This ensures the resulting sealing channel in the lid conformingly secures to the cup and seals it. Without the draw and pressure rings, however, portions of the paper blank can get caught between the slide segments causing substantial crimps in the wall of the lid's sealing channel.

These substantial crimps may limit the sealability of the lid on the cup. In this illustrative embodiment, the draw and pressure rings holding the blank while being pressed into the lid prevents it from getting substantially caught between two adjacent sliders to cause the substantial crimp. It is contemplated that in some embodiments a slight crimp may be formed on the lid's outer surface using this process, but not to the extent of it affecting the sealability of the lid on the cup or being unsightly.

Another illustrative embodiment of this disclosure provides a substantially crimpless and monolithic paperboard container lid comprising a single contiguous molded paperboard body configured to conformingly couple to a top periphery of a container for covering the container's opening. The body comprises a sealing ring located adjacent the body's periphery. The sealing ring includes a sealing channel composed of a radiused cross-section that extends to a tangent ring terminating with a tab ring. The radiused cross-section and tangent ring are configured to at least partially wrap around the top periphery of the container. The radiused cross-section has a radius greater than 180 degrees to assist providing a snug friction fit between the lid and the container. Despite being made from paperboard, the lid does not include one or more substantial crimps in the sealing ring. Having no substantial crimps, the lid fits onto the container and prevents fluid from leaking between the container's periphery and the lid. It is, nevertheless, appreciated that substantially crimpless does not mean there can be no minor crimp on the exterior surface of the lid, rather, the crimp cannot inhibit sealability of the lid. Lastly, the tab ring flares outward from the tangent ring providing a lip for grasping the lid.

In the above and other illustrative embodiments, the substantially crimpless and monolithic paperboard container lid may further comprise: the lid's size along with the sealing channel being configured to accommodate the circumference of the bottom of the container to assist in allowing the lid to serve as a stackable surface for additional containers; an emboss formed on a surface of the lid for adding strength to the lid; the shape of the lid simulating the shape of a conventional plastic lid; a poly coating applied to one surface of the paperboard lid; a clay coating applied to a surface of the paperboard lid opposite the surface with the poly coating applied thereon to accommodate printing of indicia on the lid; the paperboard thickness being from about 0.012 inch to about 0.030 inch; the shape of the paperboard being modifiable to accommodate the shape of the sealing ring of the container; the radiused cross-section of sealing ring can be either round, square, rectangular, oval, or oblong to conformingly fit the periphery of the container.

Another illustrative embodiment of the disclosure includes a method of manufacturing a crimpless and monolithic paperboard container lid. The method comprises the steps of: providing a press configured to make the crimpless and monolithic paperboard container lid, wherein the press comprises a male flange, a draw ring, a blank stop, a pressure ring, shoulder bolts, a female flange, a base, a male body, a plurality of slides, a support, and a plurality of springs; wherein the male flange is located over the draw ring, the blank stop extends from the pressure ring which receives the draw ring, wherein the shoulder bolts connect the female flange to the pressure ring with the base sandwiched in between, wherein the plurality of slides are positioned around the periphery of the support with the springs biasing thereagainst, the support includes a surface having a channel surface configured with the shape of at least a portion of the container lid, the base is configured to engage the plurality of slides on an angled plane relative to an axis of movement of the male body, wherein the plurality of slides include a contact surface that forms at least a portion of a sealing channel on the blank when forming the container lid, wherein the male body includes a contact surface having protrusions that correspond to the surface of the support, the channel surface, and the slide's contact surface, wherein the female flange supports a cavity support via spring members and the base; seating a blank on the female pressure ring; holding the blank on the press with the blank stop; lowering the male draw ring and male body against the support and pressure ring to sandwich the blank between the female support and male body; holding the blank between the female support and male body; moving the female support relative to the support; moving the plurality of slides against the container lid subsequent to sandwiching the container lid between the female support and male body, wherein movement of the female support relative to the support causes movement of the plurality slides, and wherein the movement of the plurality of slides is transverse to the movement of the male draw ring and male body; compressing the blank from both vertical and lateral directions to form the shape of the container lid; and preventing a substantial crimp to be formed in a sealing channel portion of the container lid by reducing any seam between the plurality of slides and limiting the amount of material from the blank that can fit between adjacent slides as the plurality of slides compress to form the container lid by holding the blank between the female support and male body.

In the above and other embodiments, the method may further comprise the steps of: retracting the male body toward the draw ring after the container lid is formed, prying the container lid from the male body by the draw and pressure rings holding the lid as the male body is moved, and moving the plurality of slides away from the female support; moving the support to overcome the bias force and the surface of the plurality of slides to conform to the surface of the male body to fully form the container lid's final shape, and moving the plurality of slides away from the support via the springs allowing loading and unloading of the container lid under non-compressive conditions.

Additional features and advantages of the container lid and method will become apparent to those skilled in the art upon consideration of the following detailed description of the illustrated embodiment exemplifying the best mode of carrying out the container lid and method as presently perceived.

BRIEF DESCRIPTION OF DRAWINGS

The present disclosure will be described hereafter with reference to the attached drawings which are given as non-limiting examples only, in which.

Figure 2:
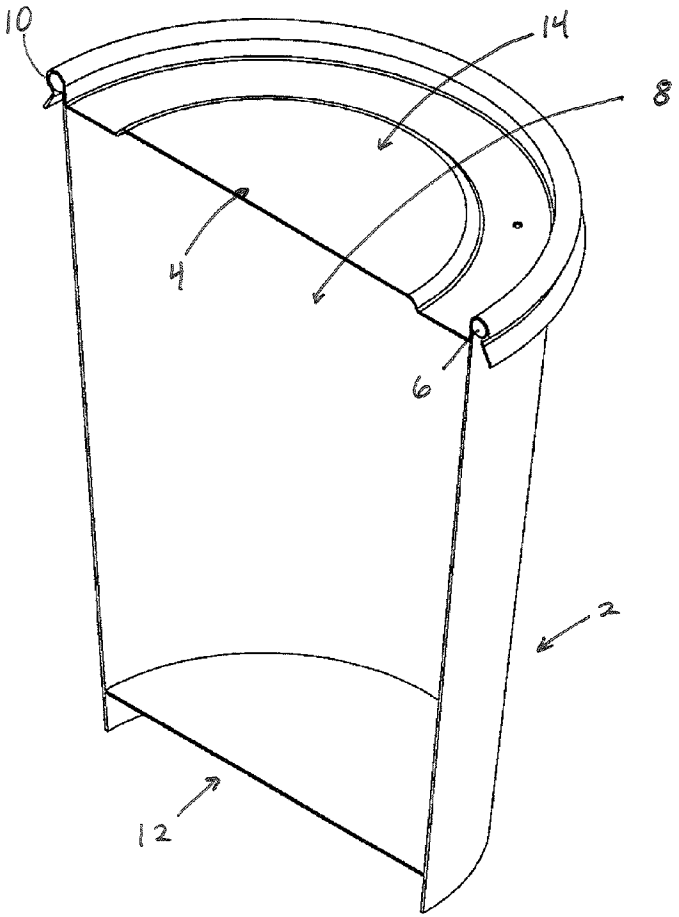
FIG. 2 is a perspective cut-away view of the fluid container in paperboard lid of FIG. 1.

Corresponding reference characters indicate corresponding parts throughout the several views. The exemplification set out herein illustrates embodiments of the container lid and method, and such exemplification is not to be construed as limiting the scope of the container lid and method in any manner.

DETAILED DESCRIPTION OF THE DRAWINGS

Figure 1:
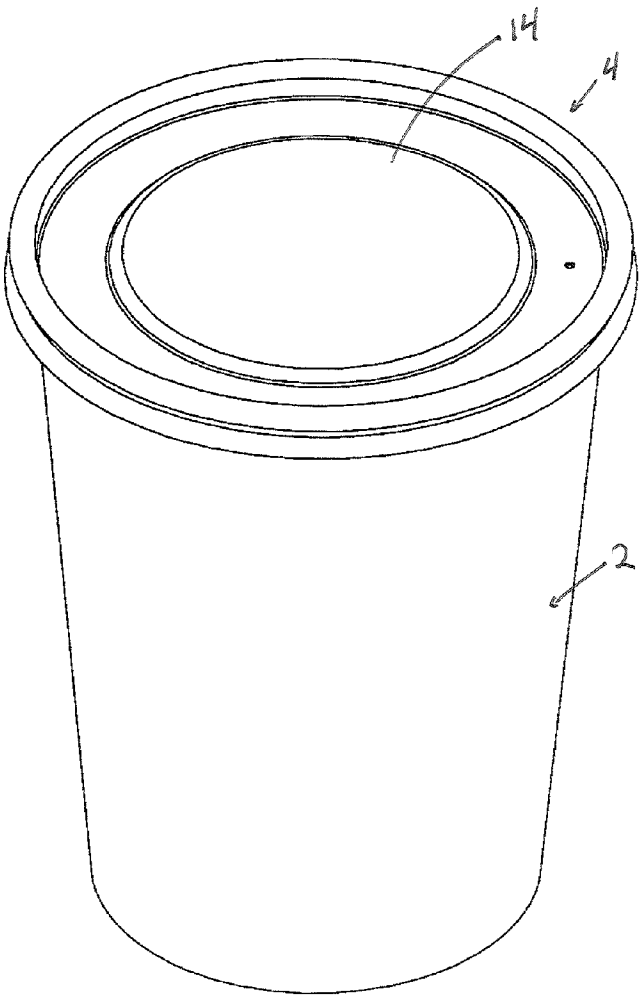
FIG. 1 is a perspective view of a fluid container with a paperboard lid coupled thereto.

Perspective and cut-away views of fluid container 2, such as a coffee or soup cup and a paperboard lid 4 coupled thereto, are shown in FIGS. 1 and 2, respectively. In this illustrative embodiment, paperboard lid 4 conformingly attaches to container 2. As particularly shown in FIG. 2, an embodiment of container 2 includes a sealing ring 6 that extends around the periphery of opening 8. Illustratively, sealing ring 6 has a cylindrical cross-section. It is appreciated, however, that the periphery of opening 8 can have a ring of any variety of cross-sections and that lid 4 comprises a sealing channel 10 configured to conformingly fit onto ring 6 in a manner like that shown in FIG. 2. It will also be appreciated that the size of lid 4 along with sealing channel 10 can be configured to accommodate the circumference of bottom 12 of container 2. This assists in allowing lid 4 to serve as a stackable surface for additional containers 2, the concept of which is known by those skilled in the art. Also in this illustrative embodiment of lid 4, emboss 14 formed on surface 24 assists in adding strength and rigidity to the lid 4.

Perspective, top, and side cross-sectional views of a formed paperboard lid 4 are shown in FIG. 3*a-c*. The configuration of lid 4 may simulate that of conventional plastic lids. Paperboard lid 4 illustratively includes a poly coating on one side and may or may not have a clay coating on the other side. The poly coating makes the paper liquid resistant while the clay coating allows printing of customer information or other indicia on lid 4. Paper thickness for lid 4 may vary from about 0.012" to about 0.030" thick, for example.

As can be appreciated from these views, the illustrative embodiment includes sealing channel 10 composed of a radius top 18 illustratively extending to a tangent 20 that terminates with a tab 22. Radius top 18 and tangent 20 wrap around sealing ring 6 located at the peripheral rim of cup 2. Radius top 18 in this embodiment illustratively includes a radius greater than 180 degrees. Tangent 20 assists extending radius top 18 over ring 6. Tab 22 flares outward from tangent 20 providing a contact surface or lip for removing lid 4 from cup 2. It is further appreciated that channel 10 is sized to fit over ring 6 providing a snug friction fit between lid 4 and cup 2, similar in character to conventional mating between paper cups and plastic lids. It will also be appreciated that the radius or cross-section of cup 18 can be modified to accommodate the shape of sealing ring 6 on cup 2. For example, in alternate embodiments, the cross-section of sealing ring 6 may be square, rectangular, oval, or oblong. Top 18 can similarly be conformingly modified to fit over those cross-sections.

Figure 4:
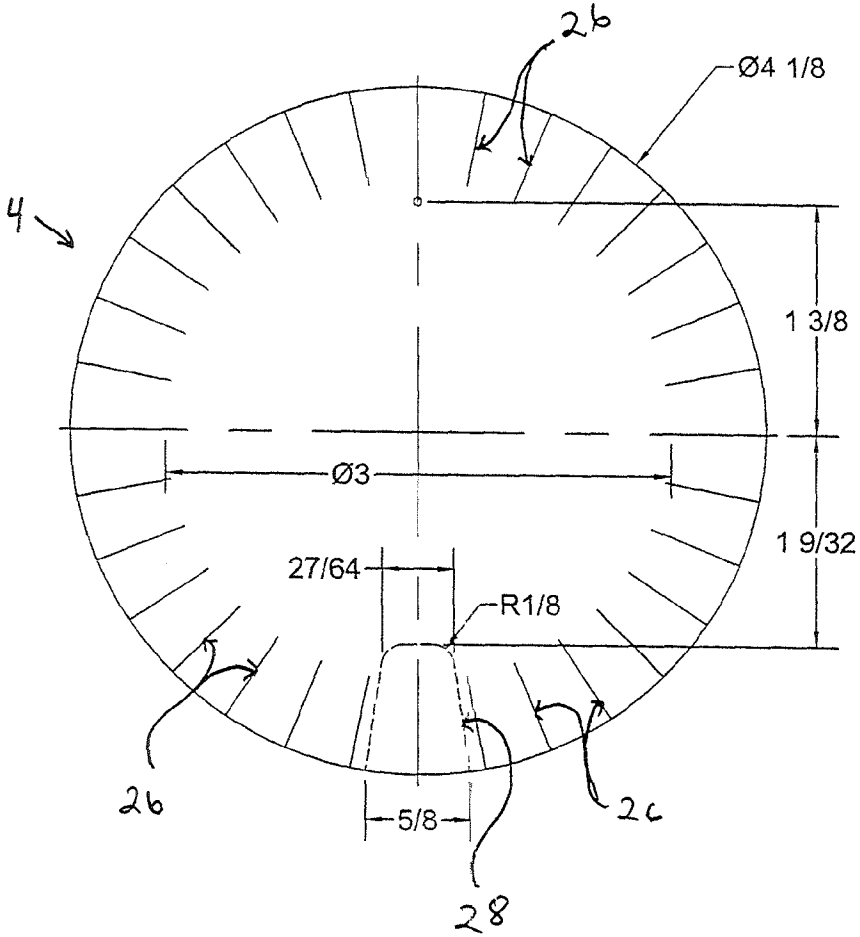
FIG. 4 is a top view of a circular "blank" prior to being formed into a container lid.

A top view of an illustrative embodiment of lid 4 as a circular "blank" is shown in FIG. 4. In an embodiment, the blank forming lid 4 can be a circular sheet of paper or paperboard having a diameter of about 4.142 inches. It is appreciated, however, that the thickness and diameter can vary depending on the material and requisite size and shape requirements of the mating cup.

In an illustrative embodiment, lid 4 in blank form is prescored. A scoring tool can be used to form grooves 26 into lid 4 that are approximately 3/16 to 3/8 inches long and about 0.002 to about 0.005 inches deep. There may be anywhere from about 24 to about 60 scores positioned radially and extending the circumference of blank 4, such as grooves 26 shown in FIG. 4. In another illustrative embodiment, the blank form of lid 4 may include a perforated pattern 28 formed in its surface. The perforated material can be removed to create a spout when the lid 4 is in final shape, similar to plastic cup lids. The perforated area may also include a tab to help pull off the spout. It is appreciated that other embodiments of lid 4 may include grooves having different thicknesses, depths, and quantities.

Figure 5:
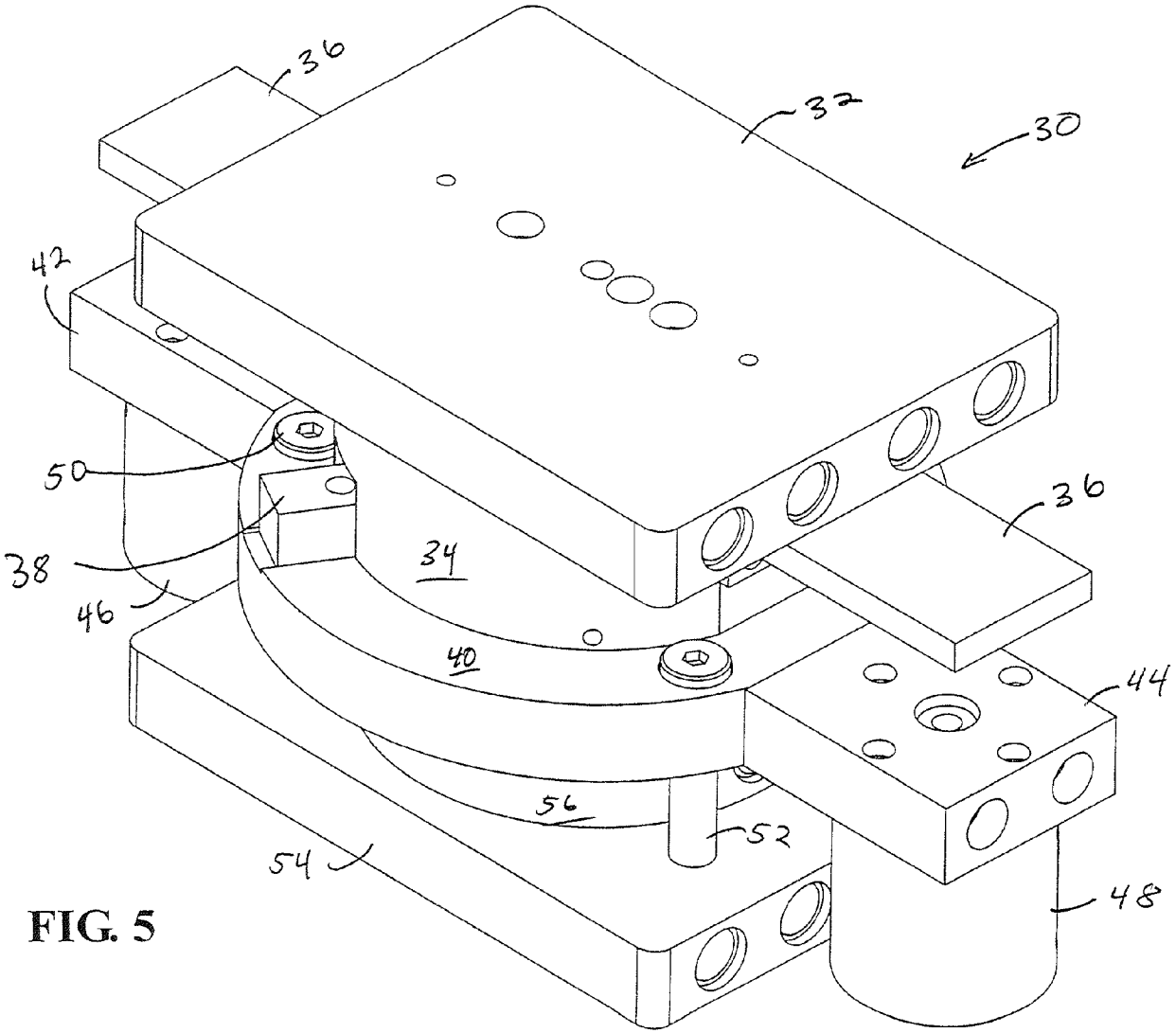
FIG. 5 is a perspective view of a paperboard lid press.

The views in FIGS. 5-13 show machinery and processes for making the paper blank into lid 4. A perspective view of press 30 is shown in FIG. 5 capable of making paperboard lid 4. Press 30 illustratively comprises a male flange 32 located over draw ring 34 and knock down ear 36. A blank stop 38 extends from pressure ring 40 and pressure ring 40 receives draw ring 34. Cylinder ears 42 and 44 flank pressure ring 40 and are configured to receive fluid cylinders 46 and 48. Shoulder bolts 50 and 52 connect female flange 54 to pressure ring 40 with base 56 sandwiched in between.

FIGS. 6-10 are a series of progression views showing how press 30 operates to form lid 4. As shown, particularly in FIG. 6, press 30 is in the open position with draw ring 34, male body or die 58, knock down ears 36, and male flange 32 all suspended above the paper blank form of lid 4 seated on female pressure ring 40. Stop 38 is located on pressure ring 40 to hold the blank onto press 30.

Also shown in this view is female flange 54 supporting cavity support 64 via springs 66 and base 56. In an illustrative embodiment, fasteners 68 are disposed through base 56 and extend into channels 90 of support 64. Slide 70, or a plurality of slides 70, is (are) illustratively positioned around the periphery of support 64 with springs 72 biasing thereagainst, as illustratively shown. It is appreciated that slides 70 may be composed of any number of slides members. (See FIGS. 12 and 13.) It is further appreciated that base 56 engages slide 70 on an angled plane 74 relative to the axis of movement 76 of male body 58. In the illustrative embodiment, the angle is about 30 degrees. It is appreciated however, that other lid designs may employ a different angle.

Figure 3:
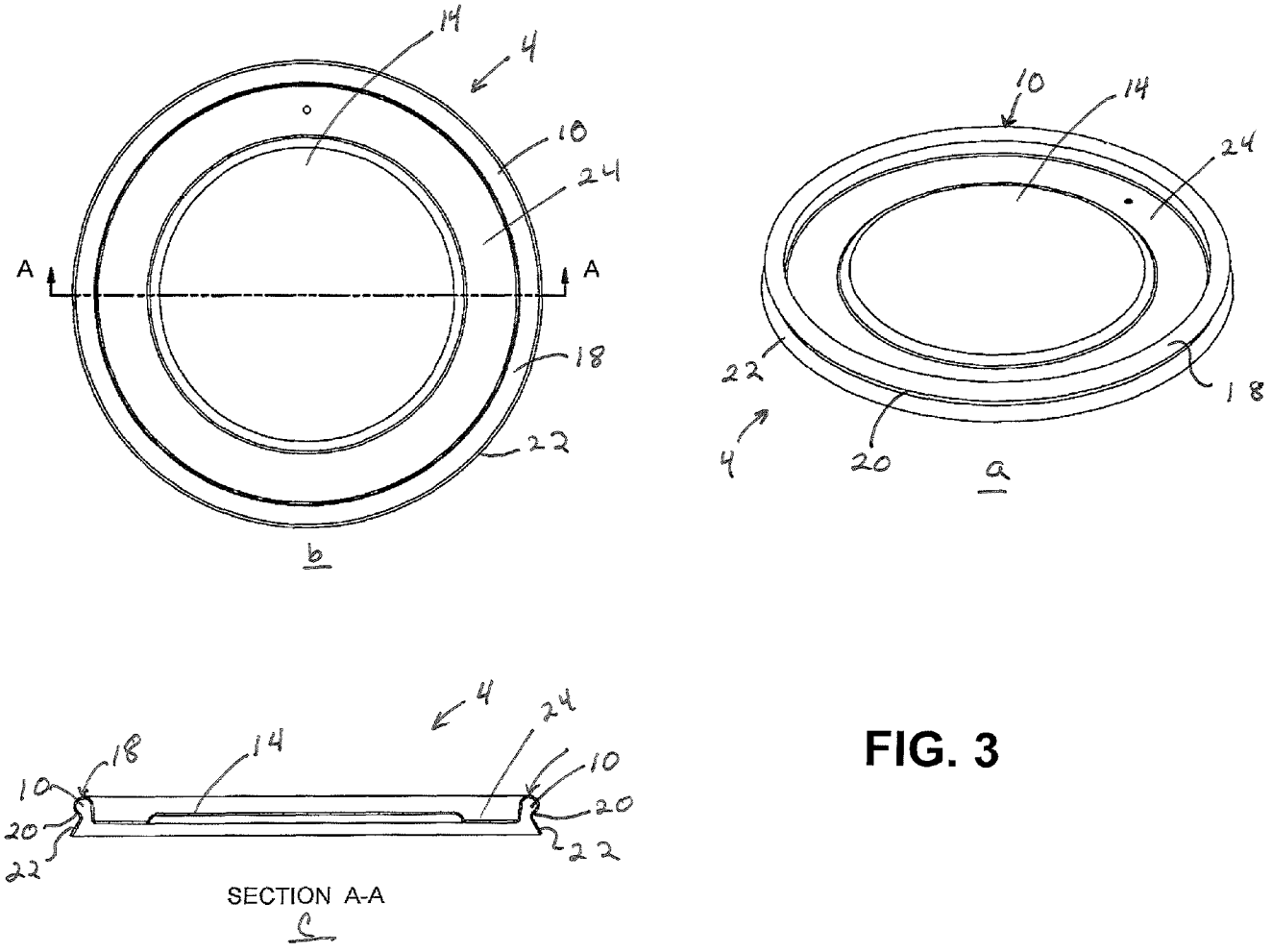
FIGS. 3*a-c* are perspective, top, and side cross-sectional views of a formed paperboard lid.

In this embodiment, support 64 includes a surface 80 that illustratively includes a channel surface 82 that receives lid 4 to form emboss 14. (See FIGS. 1 and 2.) A surface 84 of slides 70 may also include a contact surface that forms at least a portion of sealing channel 10. It is appreciated that the precise shapes of these mold surfaces can be changed to form the desired shape of the lid 4. Air cylinders 46 and 48 raise pressure ring 40 to exert pressure on lid 4 and draw ring 34. This embodiment also includes plunger component 85 with surface 87 to form emboss 14 on lid 4 as shown in FIGS. 1-3.

Figure 7:
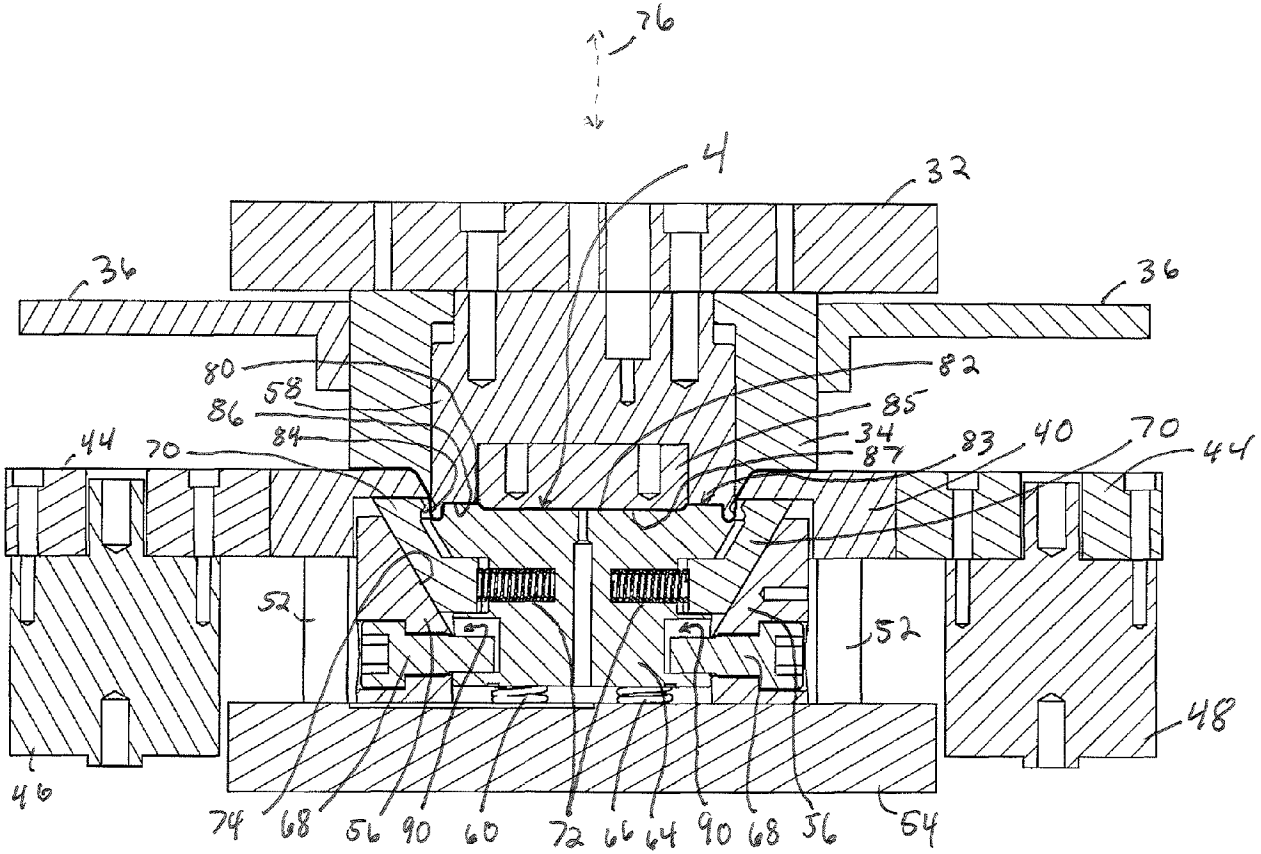
FIG. 7 is another cross-sectional view of the press of FIG. 5 with a male body and draw ring lowering against a support.

The view shown in FIG. 7 depicts male draw ring 34 and male body 58 lowering against support 64 and pressure ring 40 sandwiching lid 4 therebetween. It is appreciated, as shown in this illustrative embodiment, that surface 86 of male body 58, and surface 87 of plunger component 85 correspond to surfaces 80, 82, and 84. As shown in this view, lid 4 is sandwiched between the female support 64 and male body 58. Illustratively, slides 70 are not yet being drawn towards lid 4 to fully compress it into shape.

Figure 8:
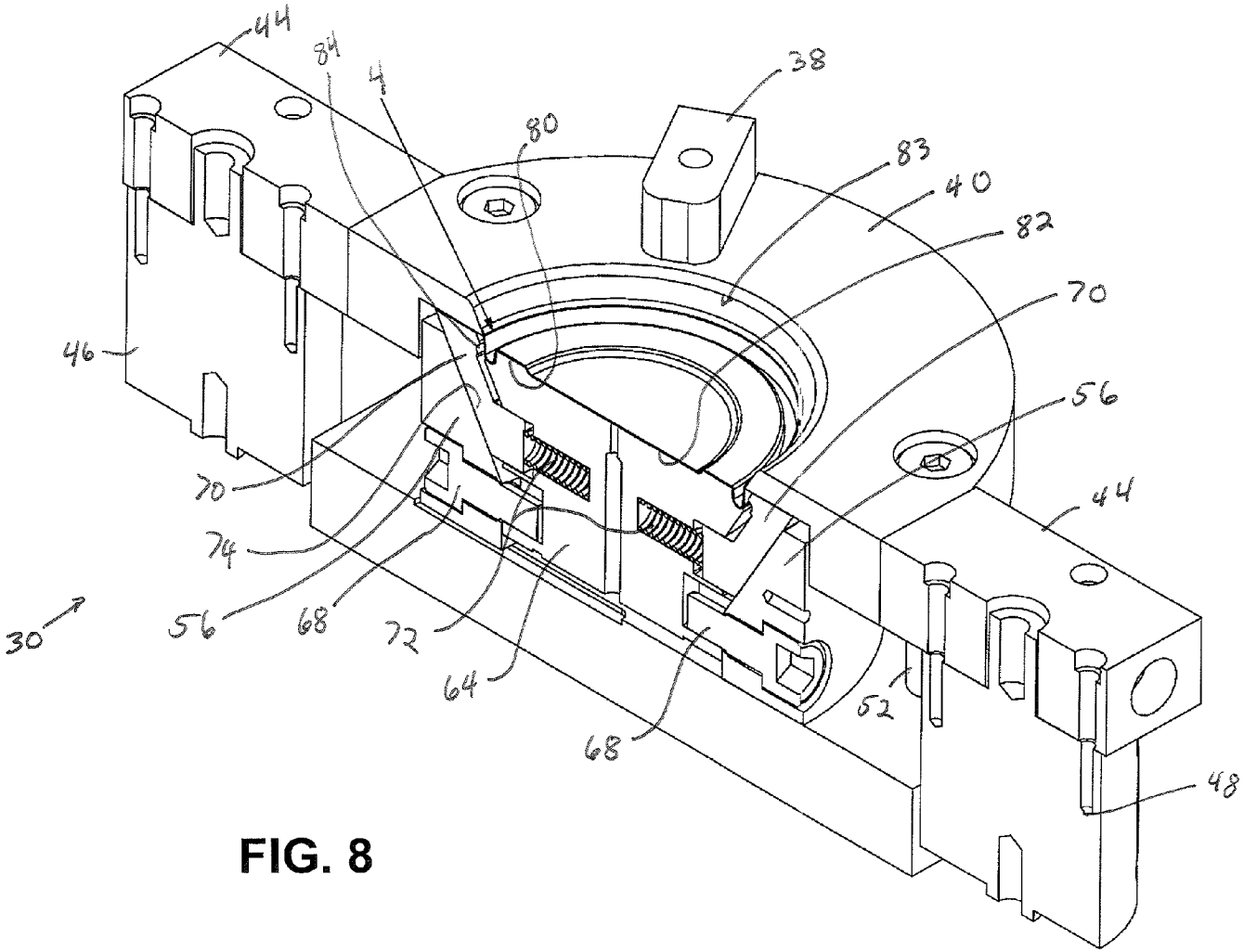
FIG. 8 is a cross-sectional perspective view of the lower half portion of the press of FIG. 5.

A cross-sectional perspective view of press 30, shown in FIG. 8, removes male body 58, ring 34, knock down ear 36, and male flange 32 to better depict the positioning of lid 4 within cavity 83 collectively made from ring 40, slides 70, and support 64. This view also shows stop 38 that holds blank 4 in position until it is trapped between draw ring 34 and pressure ring 40.

Figure 9:
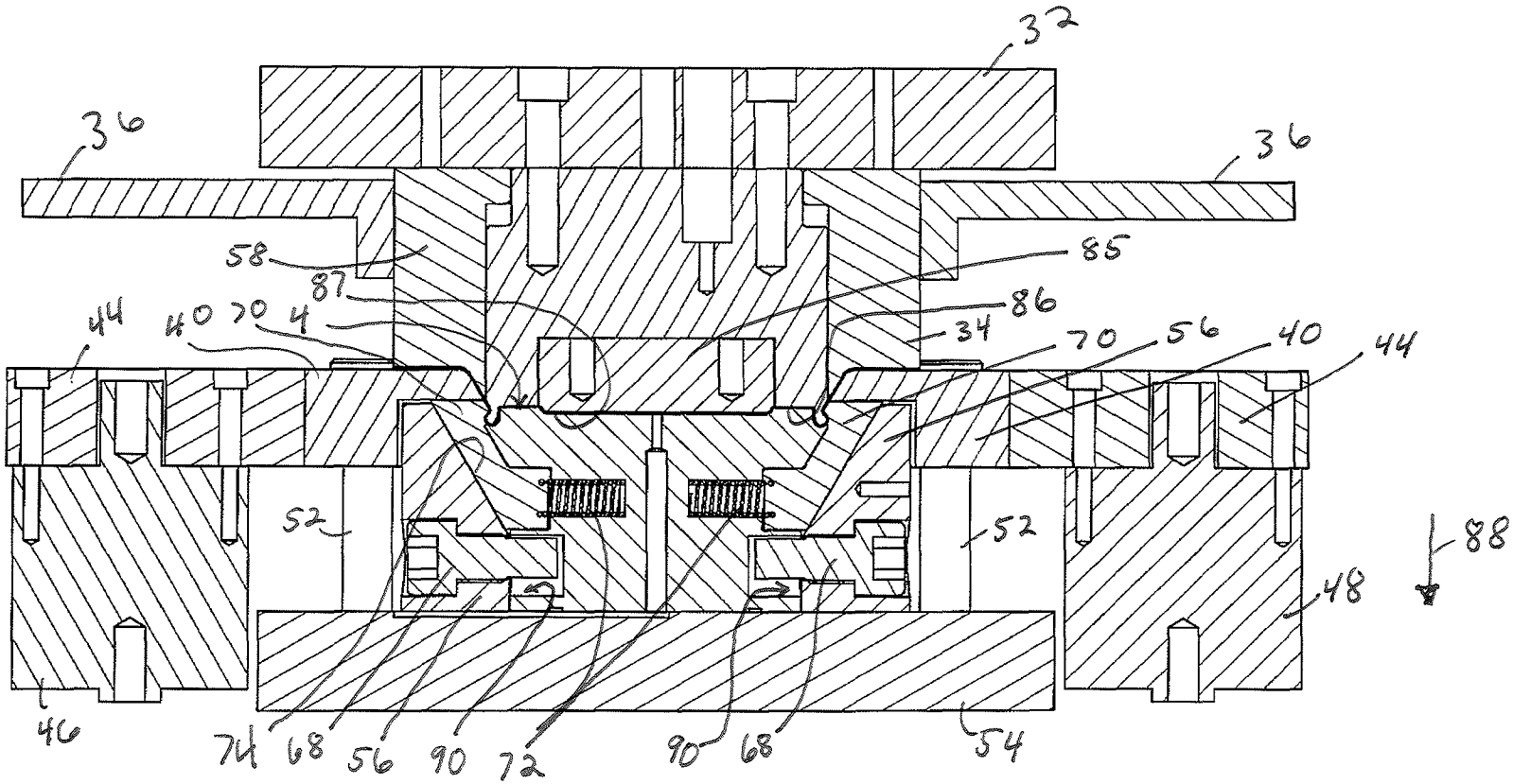
FIG. 9 shows both the male body lowered against the support, but also slides laterally drawn in against the support and the male body to form the container lid from the blank.

The cross-sectional view shown in FIG. 9 depicts not only the male and female mold components compressed to form lid 4, but now a lateral compressive force is applied to lid 4 via slides 70.

Figure 6:
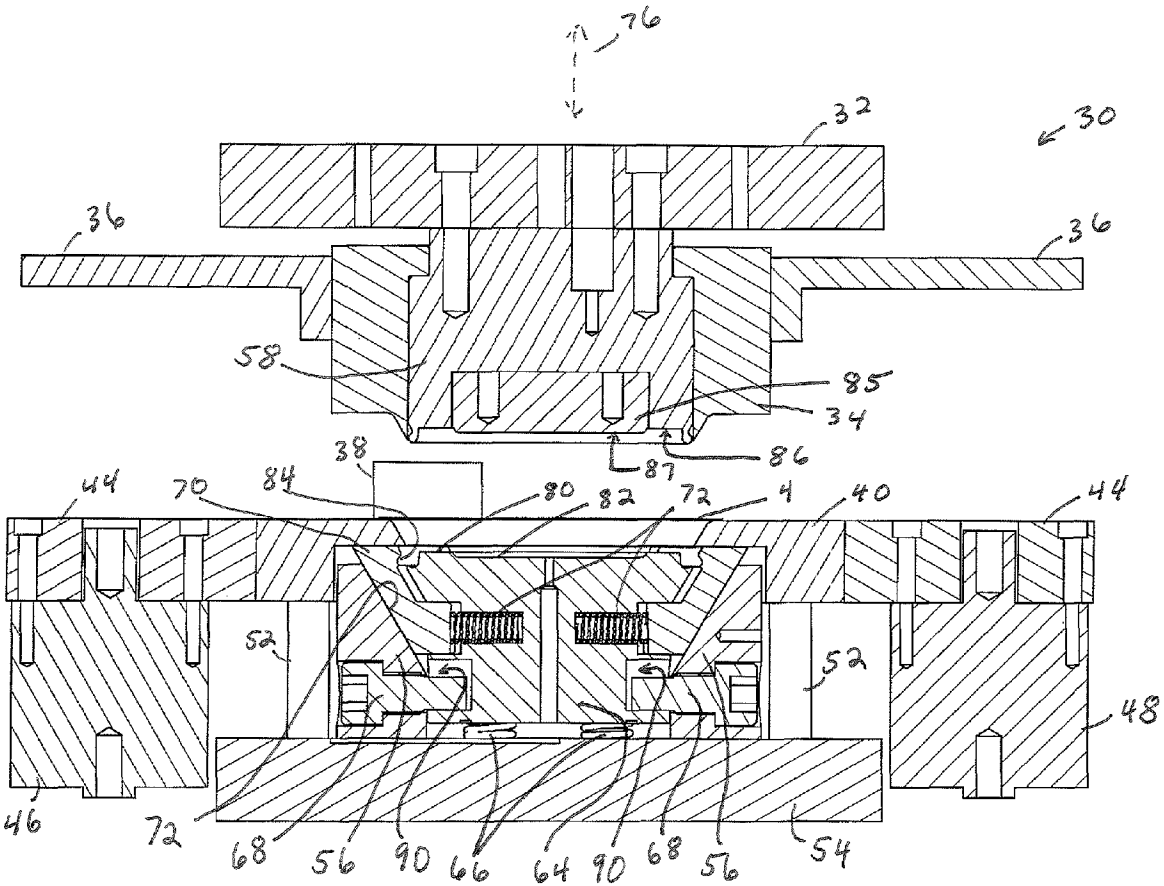
FIG. 6 is a cross-sectional view of the press of FIG. 5 in an open position.

As shown therein, flange 32 extends downward in direction 88 compressing springs 66 (not shown, see FIG. 6). This forces male body 58 and plunger 85 to also move in direction 88 to engage support 64. As shown in this view, lid 4 sandwiched therebetween is not only subjected to a compressive force from support 64 and body 58, but is also subjected to lateral forces from slides 70 helping form lid 4's three-dimensional shape. Support 64 is pushed downward in direction 88, which by virtue of its downward movement forces slide 70 down on angle surface 74. Channels 90 within support 64 are sized to allow fastener 68 to restrict the travel of support 64. (Compare the relative positions of fasteners 68 in channel 90 between FIG. 6 and FIG. 9.) This movement of support 64 causes a compressive force by slides 70 against the bias of springs 72. Under non-compressive conditions, springs 72 keep slides 70 away from support 64 allowing loading and unloading of lid 4. Movement of support 64 overcomes that bias force and the surfaces 84 of slides 70 conform to surface 86 of male body 58 to fully form lid 4's final shape.

Figure 10:
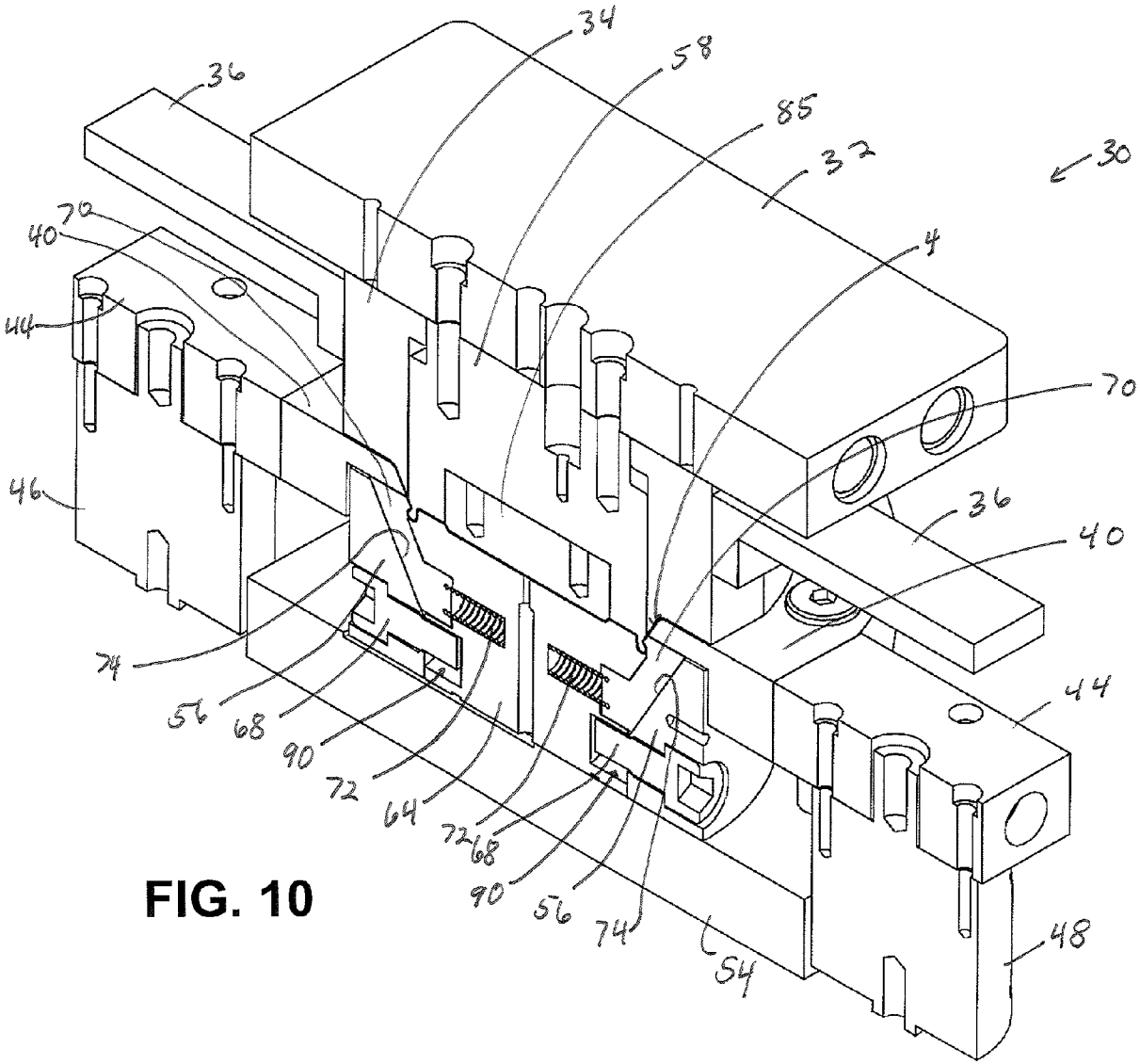
FIG. 10 is a perspective cross-sectional view of the press in the position discussed with respect to FIG. 9.
Figure 11:
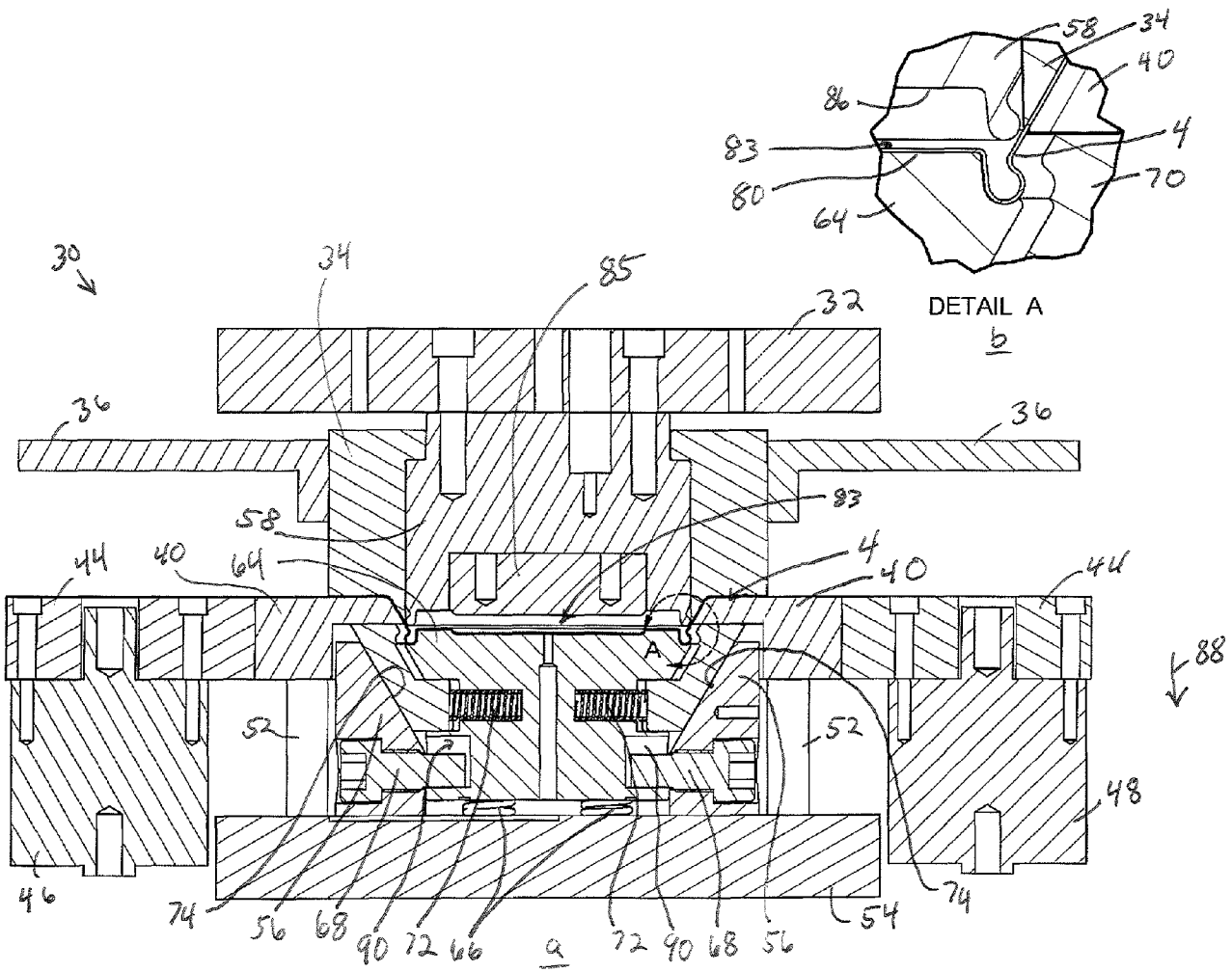
FIGS. 11*a* and *b* are a side cross-sectional and detail views of the press demonstrating how the container lid is stripped off.

A cross-sectional perspective view of press 30 is shown in FIG. 10. The components of press 30 in this view are in the same position as that shown in FIG. 9. This view, however, depicts how slides 70 are being compressed against support 64. Lid 4 is sandwiched between slides 70, male body 58, and support 64 forming the final lid shape.

The perspective elevation view shown in FIG. 11*a* depicts how lid 4 is stripped off of male body 58 once fully formed. Male body 58 retracts inside draw ring 34. Because a portion of lid 4 extends between draw ring 34 and pressure ring 40, it is held in place. Lid 4 is pried from male body 58 and is left sitting in cavity 83. In addition, slides 70 expand as female support 64 moves upward because of bias from springs 66. This in turn causes the slides 70 to move up and back thereby lowering base 56 and allowing bias of springs 72 to push slides 70 away from support 64.

The detail view shown in FIG. 11*b* further depicts male body 58 being removed from lid 4 with draw ring 34 and pressure ring 40 continuing to hold lid 4 in place. This view also shows slide 70 spaced apart from lid 4 after formation.

Figure 12:
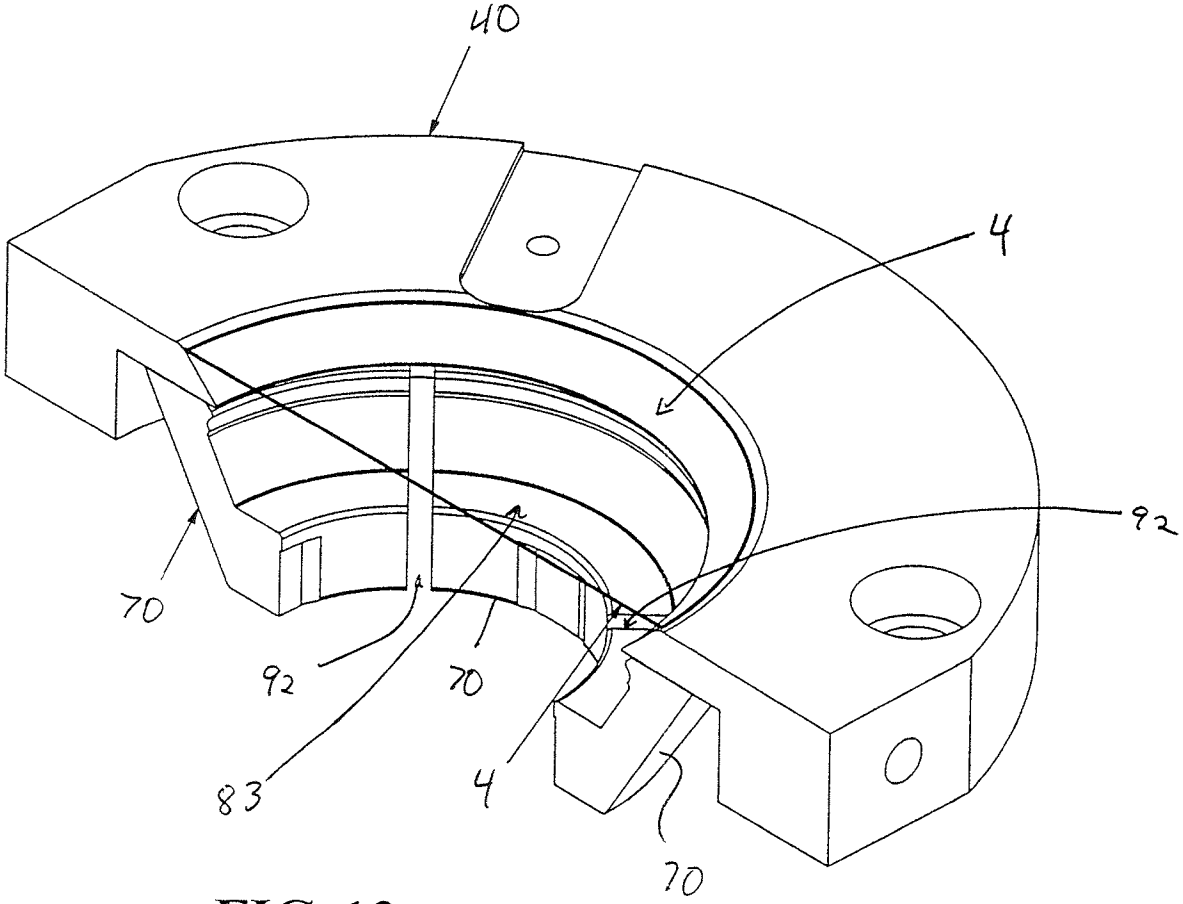
FIG. 12 shows a detail perspective cut-away view of pressure ring and slides.
Figure 13:
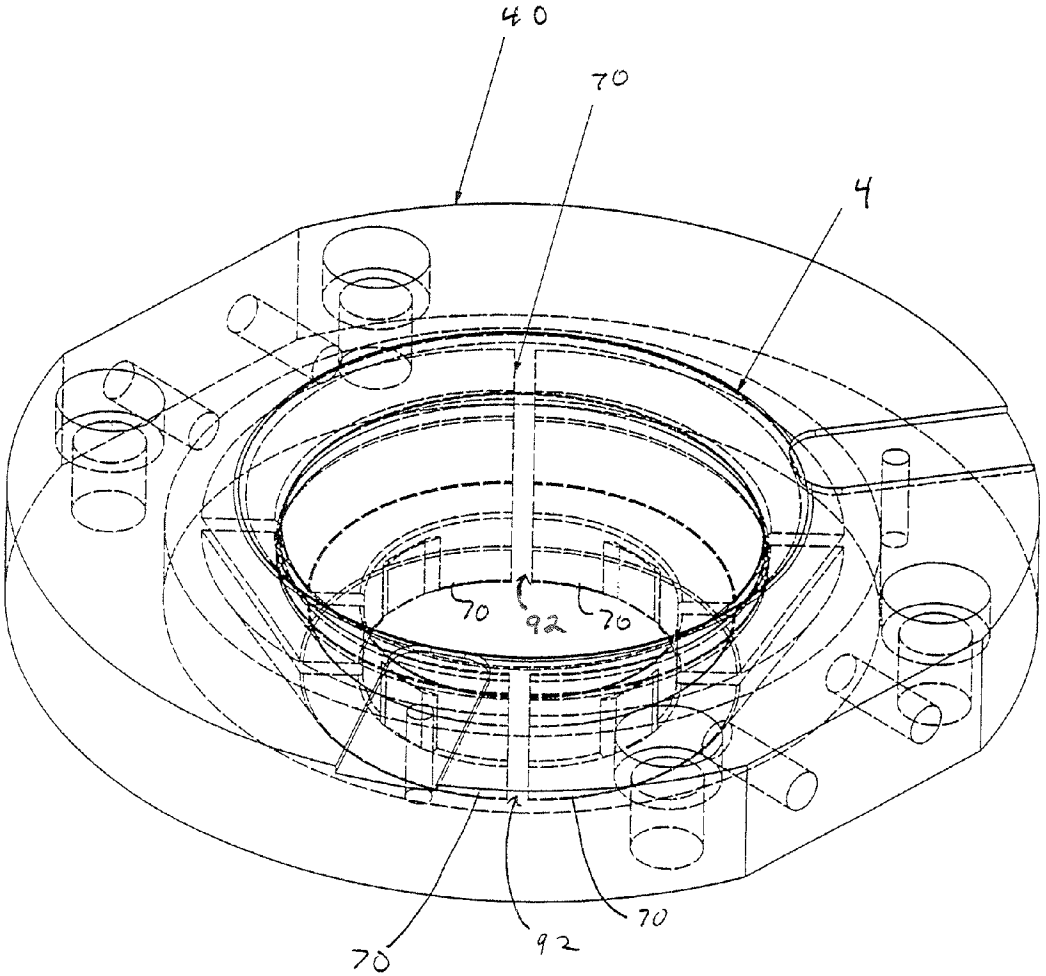
FIG. 13 is a perspective detail wire view of the pressure ring, slides, and a blank.

FIGS. 12 and 13 are detail perspective views showing pressure ring 40, paper blank 4, and slides 70. In this view, blank 4 is shown in transparent view to show slides 70 positioned underneath. When male body 58 depresses blank 4 into cavity 83, draw ring 34 will hold blank 4 against pressure ring 40. As slides 70 close, blank 4 will be molded into the lid. There is a risk that a portion of blank 4 will be caught in a seam 92 located between adjacent slides 70, as shown. If a substantial enough amount of paper from blank 4 gets caught in seam 92, a crimp in the lid will be formed which not only detracts from the physical appearance of the lid, but also serves as a break in any seal created between the lid and the cup. Losing the seal between the cup and the lid can be detrimental if fluid, particularly hot fluid such as coffee, contacts the seal between the lid and the cup and is allowed to seep out. It is contemplated in an embodiment, however, that a minor amount of crimp may still occur even if using the pressure and draw rings, but that crimp is nominally sized and does not affect the sealing of the lid onto the cup.

The view shown in FIG. 13 is similar to that shown in FIG. 12 except that pressure ring 40 and blank 4 are shown in transparent view to better illustrate how the four slides 70 are positioned with respect to each other and the seam or gap 92 exist prior to slides 70 being drawn towards each other during the molding process.

Although the present disclosure has been described with reference to particular means, materials, and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

What is claimed is:

1. A method of manufacturing a crimpless and monolithic paperboard container lid, comprising the steps of:

providing a press configured to make the crimpless and monolithic paperboard container lid, wherein the press comprises a first flange, a draw ring, a blank stop, a pressure ring, shoulder bolts, a second flange, a base, a male body, a plurality of slides, a support, and a plurality of springs; wherein the first flange is located over the draw ring, the blank stop extends from the pressure ring which receives the draw ring, wherein the shoulder bolts connect the second flange to the pressure ring with the base sandwiched in between, wherein the plurality of slides are positioned around the periphery of the support with the springs biasing thereagainst, the support includes a surface having a channel surface configured with the shape of at least a portion of the container lid, the base is configured to engage the plurality of slides on an angled plane relative to an axis of movement of the male body, wherein the plurality of slides include a contact surface that forms at least a portion of a sealing channel on the blank when forming the container lid, wherein the male body includes a contact surface having protrusions that correspond to the surface of the support, the channel surface, and the slide's contact surface, wherein the second flange supports a cavity support via spring members and the base;

seating a blank on the female pressure ring;

holding the blank on the press with the blank stop;

lowering the male draw ring and male body against the support and pressure ring to sandwich the blank between the female support and male body;

holding the blank between the female support and male body;

moving the female support relative to the support;

moving the plurality of slides against the container lid subsequent to sandwiching the container lid between the female support and male body, wherein movement of the female support relative to the support causes movement of the plurality slides, and wherein the movement of the plurality of slides is transverse to the movement of the male draw ring and male body;

compressing the blank from both vertical and lateral directions to form the shape of the container lid; and preventing a substantial crimp to be formed in a sealing channel portion of the container lid by reducing any seam between the plurality of slides and limiting the amount of material from the blank that can fit between adjacent slides as the plurality of slides compress to form the container lid by holding the blank between the female support and male body.

2. The method of manufacturing the crimpless and monolithic paperboard container lid of claim 1, further comprising the steps of:

retracting the male body toward the draw ring after the container lid is formed;

prying the container lid from the male body by the draw and pressure rings holding the lid as the male body is moved; and moving the plurality of slides away from the female support.

3. The method of manufacturing the crimpless and monolithic paperboard container lid of claim 1, further comprising the steps of: moving the support to overcome the bias force and the surface of the plurality of slides conform to the surface of the male body to fully form the container lid's final shape; and moving the plurality of slides away from the support via the springs allowing loading and unloading of the container lid under non-compressive conditions.

* * * * *